US007922576B2

(12) United States Patent
Schneider

(10) Patent No.: US 7,922,576 B2
(45) Date of Patent: Apr. 12, 2011

(54) SYSTEM FOR IMPLEMENTING A SECONDARY GAME

(75) Inventor: Richard J. Schneider, Las Vegas, NV (US)

(73) Assignee: IGT, Reno, NV (US)

( * ) Notice: Subject to any disclaimer, the term of this patent is extended or adjusted under 35 U.S.C. 154(b) by 1111 days.

(21) Appl. No.: 10/817,060

(22) Filed: Apr. 2, 2004

(65) Prior Publication Data

US 2004/0198487 A1 Oct. 7, 2004

Related U.S. Application Data

(60) Provisional application No. 60/460,629, filed on Apr. 3, 2003.

(51) Int. Cl.
*G07F 17/34* (2006.01)

(52) U.S. Cl. ..... 463/25; 463/16; 463/17; 463/18; 463/19; 463/20; 463/29; 463/42; 463/43

(58) Field of Classification Search ..... 463/16–20, 463/25, 29, 42–43
See application file for complete search history.

(56) References Cited

U.S. PATENT DOCUMENTS

| | | | | |
|---|---|---|---|---|
| 4,856,787 | A | 8/1989 | Itkis | |
| 4,871,171 | A | 10/1989 | Rivero | |
| 5,242,163 | A | 9/1993 | Fulton | |
| 5,342,049 | A | 8/1994 | Wichinsky et al. | |
| 5,393,057 | A | 2/1995 | Marnell, II | |
| 5,743,523 | A | 4/1998 | Kelly et al. | |
| 5,823,874 | A | 10/1998 | Adams | |
| 5,848,932 | A | 12/1998 | Adams | |
| 5,882,261 | A | 3/1999 | Adams | |
| 5,910,048 | A * | 6/1999 | Feinberg | 463/25 |
| 5,947,821 | A * | 9/1999 | Stone | 463/13 |
| 6,012,982 | A | 1/2000 | Piechowiak et al. | |
| 6,135,884 | A | 10/2000 | Hedrick | |
| 6,186,894 | B1 | 2/2001 | Mayeroff | |
| 6,224,483 | B1 | 5/2001 | Mayeroff | |
| 6,309,300 | B1 | 10/2001 | Glavich | |
| 6,620,046 | B2 * | 9/2003 | Rowe | 463/25 |
| 2002/0142826 | A1 | 10/2002 | Adams | |
| 2002/0142846 | A1 * | 10/2002 | Paulsen | 463/43 |
| 2003/0054873 | A1 * | 3/2003 | Peterson | 463/20 |
| 2003/0060259 | A1 | 3/2003 | Mierau et al. | |
| 2003/0060266 | A1 * | 3/2003 | Baerlocher | 463/20 |

FOREIGN PATENT DOCUMENTS

| | | |
|---|---|---|
| EP | 0333338 A2 | 9/1989 |
| GB | 1242298 | 8/1971 |
| GB | 2072395 A | 2/1981 |
| GB | 2066991 | 7/1981 |
| GB | 2201821 A | 9/1988 |
| JP | 05-131044 | 9/1993 |
| WO | WO 99/10849 | 3/1999 |

* cited by examiner

*Primary Examiner* — Dmitry Suhol
*Assistant Examiner* — Sunit Pandya
(74) *Attorney, Agent, or Firm* — Armstrong Teasdale LLP

(57) ABSTRACT

The present system provides an incentive for players to place maximum wagers in an effort to gain access to secondary games, the entry of which is controlled by the player's own wager amount, wager type, or wager source. In employing such games, gaming machine establishments are able to maximize the level of play on each of their gaming machines and thereby reduce operation costs and increase the number of machines available for play.

21 Claims, 5 Drawing Sheets

SYSTEM FOR IMPLEMENTING A SECONDARY GAME

This application claims priority from U.S. Provisional Application No. 60/460,629, filed on Apr. 3, 2003, the contents of which are hereby expressly incorporated herein for all purposes.

TECHNICAL FIELD

This disclosure relates to networked gaming devices or machines, and, more specifically, to a system for controlling access to a secondary game responsive to a wager.

BACKGROUND

Gaming machine establishments, such as casinos, are interested in maximizing a player's playing experience by providing the player with more game variety while simultaneously maximizing the establishment's revenues. In particular, such establishments are interested in devising games that make it desirable for players to wager maximum amounts, which allows the establishment to maximize its profits with fewer gaming machines in play. By encouraging players to wager maximum amounts, establishments lower their operating and maintenance costs, or in the alternative have more machines available for play by more players.

Traditional efforts to encourage players to place maximum wagers have primarily been through greater jackpots on a single game with a single indicator, or the ability to access a progressive jackpot by placing a maximum wager on the game being played. Although these approaches encourage some players to place maximum wagers believing they will obtain greater wins by doing so, they do not enhance a player's belief that by placing the maximum wager he is gaining additional opportunities for a win.

Some game manufacturers have begun to employ secondary games used in conjunction with primary games. However, the ability to enter the secondary game has thus far been limited to those players achieving a given outcome on the primary game, for example three-of-a-kind. Therefore, as with traditional methods to encourage maximum wagers, this type of game appeals to the player desiring to experience a greater win rather than more opportunities for a win, for only upon winning on the primary game is the player eligible to play the secondary game. Once more, this type of game does not contribute to a player's belief that he has additional opportunities to win by placing a maximum wager.

Games providing additional win opportunities with increasing wager amounts are desirable both to players wishing to maximize play and desirable for gaming establishments as a means to maximize play on available machines.

Embodiments of the invention address these and other deficiencies in casino gaming systems.

BRIEF DESCRIPTION OF THE DRAWINGS

The description may be best understood by reading the disclosure with reference to the accompanying drawings.

DETAILED DESCRIPTION

Embodiments of the invention include a method for controlling access to a secondary game responsive to preselected wagers on a primary game. As used in this description, wager refers to a cash or credit amount paid for accessing play on a gaming machine or actuating one or more buttons on a gaming machine to initiate play on the gaming machine.

By using the amount wagered as a trigger for play on a secondary game, casinos and other gaming machine establishments are able to better control access to such secondary games and make them available to a greater number of players. By controlling access to play on a secondary game, the casino can customize the trigger level to encourage play. For example, casinos might want to vary the trigger level according to the amount of money taken in or paid out by the casino for a given period. Alternatively, casinos might want to vary the trigger level by factors like the day of the week or the time of day.

Figure 1:
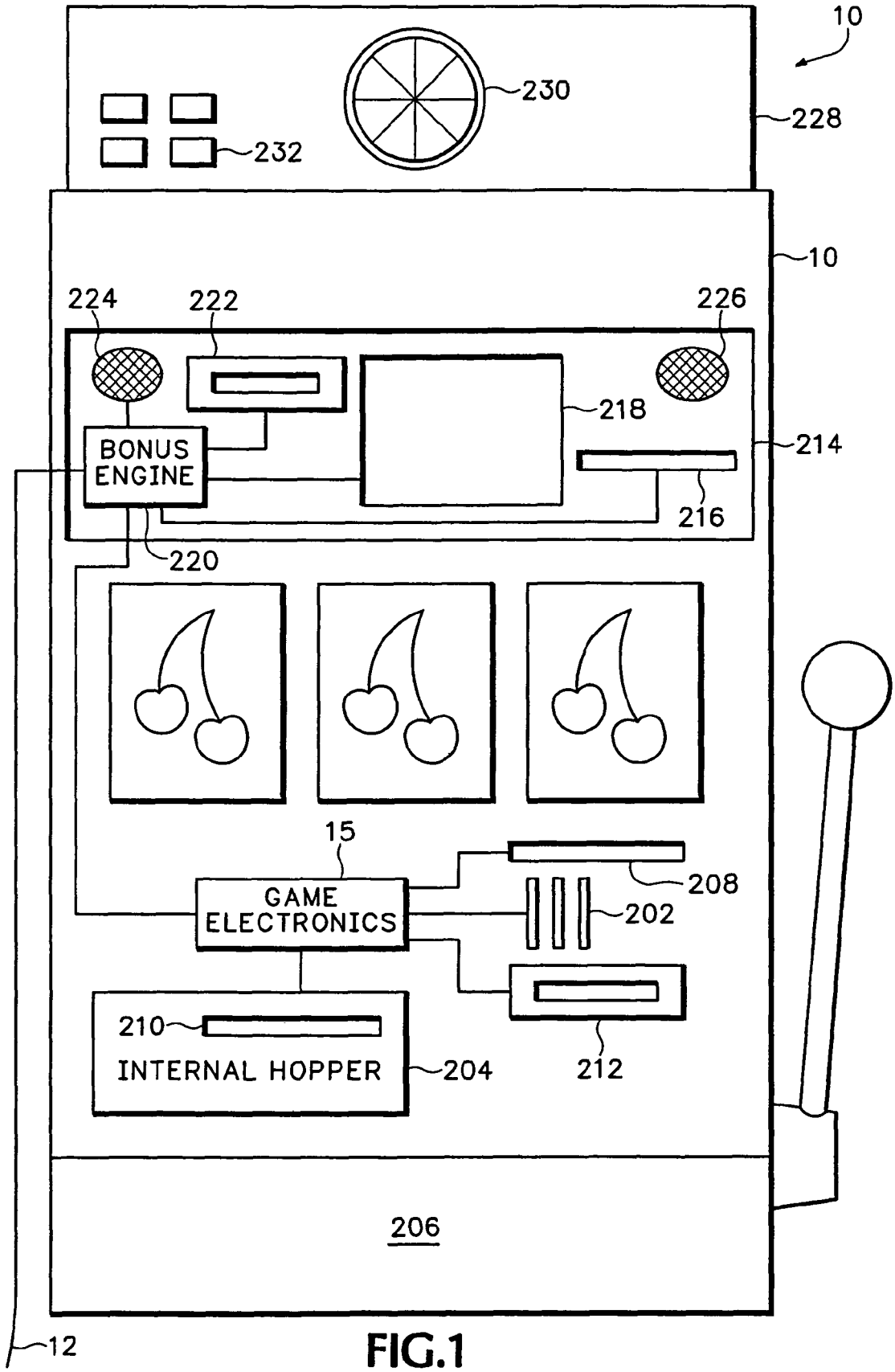
FIG. 1 is a block diagram showing a gaming device having primary and secondary games used for embodiments of the invention.

Turning to FIG. 1, an electronic gaming device ("EGM") 10 according to an embodiment of the invention is shown. The EGM 10 includes a bill acceptor 208 that accepts and validates bills, tickets or vouchers. Bill validators operate by scanning barcodes or other identifying features on tickets or vouchers, and by examining printing or other security features on paper currency to determine authenticity. Bill validators are well known in the gaming arts.

The EGM 10 also includes one or more coin slots 202 for accepting coins or tokens. An internal hopper 204 temporarily stores coins or tokens for later payment to the player through a payout bin 206, if the player chooses to cash out in such a manner. Bills can also be stored in a separate hopper, and dispensed to the player through the bill acceptor 208 or through another bill slot 210 in the machine cabinet, similar to an ATM machine.

A set of game electronics 15 manages the central operations of the gaming device 10. For example, the game electronics 15 counts the monetary value input into the EGM 10, and tracks and stores values for this and other data items. The game electronics 15 also control the game play of the EGM 10, such as by accepting user input from various buttons (not shown) to cause credits to be wagered, as well as cause motors to spin the game wheels, speakers to generate sound, and circuits to generate lights or video signals. The game electronics 15 may be a main board that interfaces with various controller boards that control specific functions in the EGM 10, or may control the various devices directly.

One of the items controlled by the game electronics 15 is an internal game printer 212. The game printer 212 can be of any type known in the art, such as impact, inkjet, thermal, laser, and can be a color printer or standard black and white. Even if the game printer 212 is only capable of printing in a single color, cardstock or paper used by the printer could be preprinted in color.

The EGM 10 also includes game-mounted components of a player tracking system. The components are generally shown affixed to a frame 214, which is mounted to the gaming device 10. Although components of the tracking system interact with the EGM 10, it is a separate system from the gaming device.

The player tracking system includes a set of electronic inputs and outputs for interfacing with the player. For example, in the gaming device shown in FIG. 1, portions of the player tracking system mounted to the frame 214 include a cardslot with a card reader 216 and a touchscreen display 218. Alternate embodiments could use a traditional keypad, not shown. The display screen 218 may be a Liquid Crystal Display (LCD), for example. The bonus engine 220 manages the touchscreen display 218, and card reader 216, as well as provides the bonusing and other functions described above. A player of the gaming device 10 uses a card and/or a PIN code to identify himself or herself to the player tracking system. Monetary value can be entered into the game, either from the ID card itself, from a credit-card account with a bank or from a special gaming account managed by a casino. Alternatively, a player can use the card and/or PIN code to identify himself or herself, and then put credits on the machine by depositing coins, tokens, bills, or tickets/vouchers into the machine.

The card reader 216 and display 218 are managed by functions operating on a "bonus engine" 220, which is a specialized piece of hardware used in the player tracking network. The bonus engine 220 is coupled by a computer connection to the gaming network, and plays a central role in the player tracking system. The bonus engine 220 is in constant communication between the game electronics 15 and the gaming network. The bonus engine 220 receives constant status updates about the state and status of the EGM 10. The game electronics 15 may automatically send information to the bonus engine 220, such as "events", when the events occur, such as at the end of the game, or when a key event happens like a bill being accepted into the EGM 10. Or, the bonus engine 220 may send electronic updates, requests, or polls to the game electronics 15. When polled, the game electronics 15 sends the latest events to the bonus engine 220. Additionally, the gaming network can send commands and directives to a particular EGM 10 through the bonus engine 220 of that device. The bonus engine 220 then performs the commands, such as by displaying a message on the display 218, or the bonus engine delivers the commands to the game electronics 15 of that gaming device.

The EGM 10 also includes a system printer 222 and speakers 224 mounted to the frame 214 of the player tracking system. The system printer 222 and speakers 226 are also coupled to and managed by the bonus engine 220. The system printer 222 works in conjunction with the game printer 212 in that the system printer 222 prints the awards while the game printer 212 prints the traditional game cashout vouchers. The speakers 224 can be made to produce sounds or music by the bonus engine 220.

The EGM 10 further includes a secondary game 228 that can be configured to operate in conjunction with the primary or base game. The secondary game 228 is made up of one or more indicia 230, such as a reel, wheel, or any other game indicator, and may include one or more wagering buttons 232, actuable by the player. The secondary game 228 may be contained within the same housing of the EGM 10 or may be an add-on sitting atop or adjacent the EGM. Preexisting EGMs not built with a secondary game 228 can therefore be retrofitted to provide the necessary electronics and displays. The configuration necessary to operate the secondary game can be specific to the EGM 10 or can be coordinated through the gaming network 5. Although the specific hardware included in the gaming device 10 is important in implementing embodiments of the invention, the invention can operate regardless of the type of components in the gaming device 10.

Figure 2A:
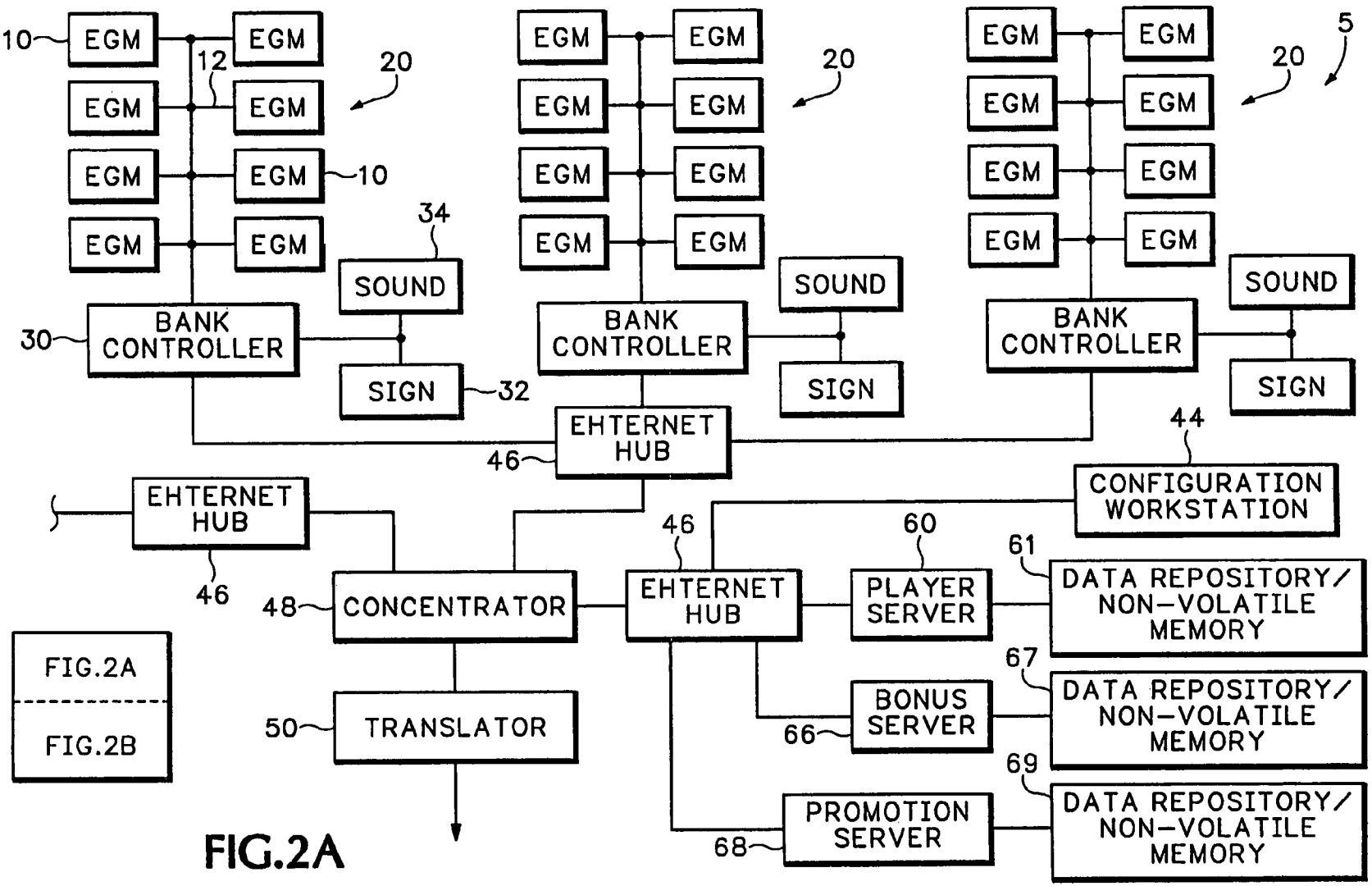
FIGS. 2A and 2B together are a block diagram showing components of a gaming network according to embodiments of the invention.
Figure 2B:
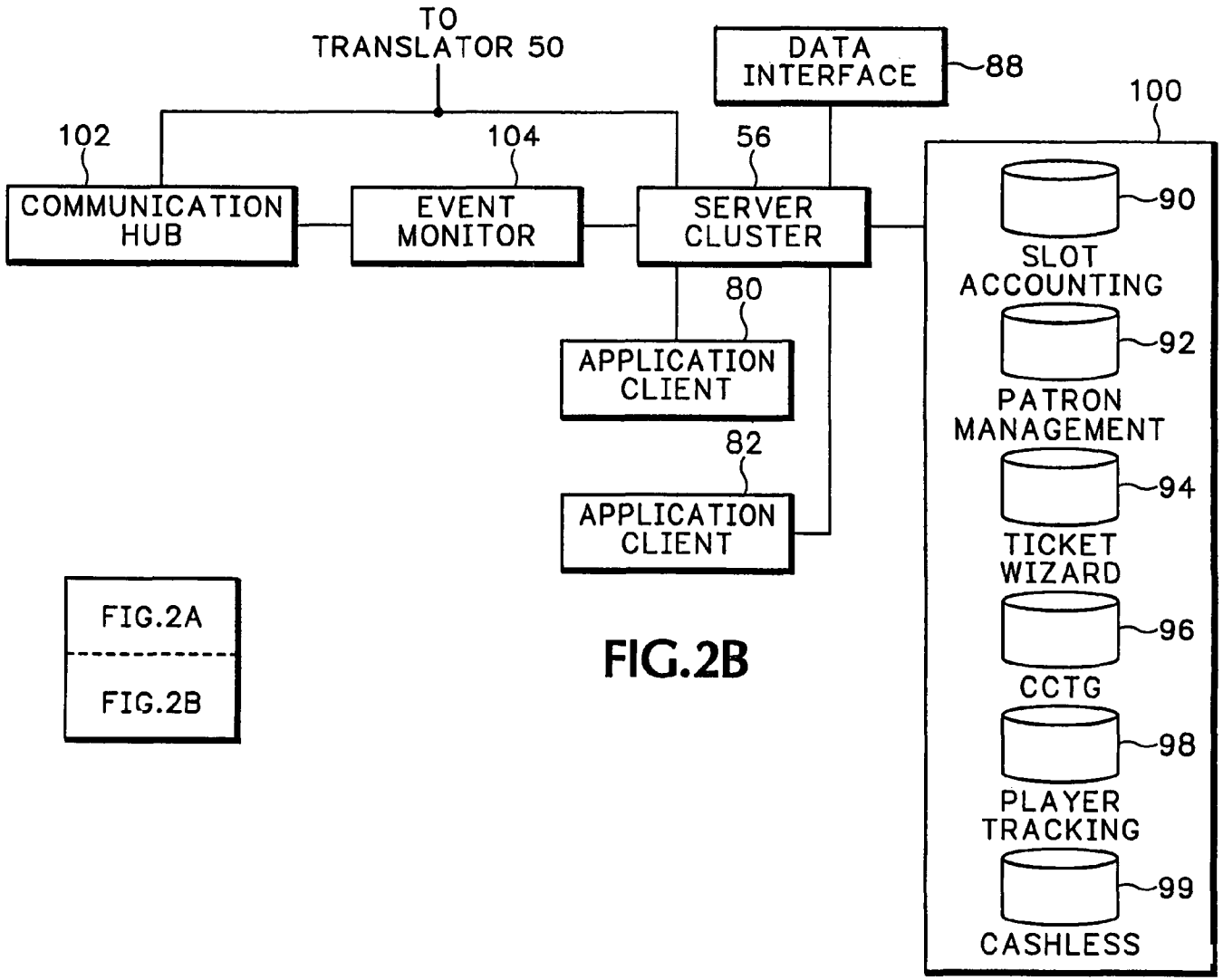

One such gaming network is illustrated in FIGS. 2A and 2B. In a gaming network 5, a number of EGMs 10 are organized in groups called banks. Individual banks 20, 22, and 24, can contain almost any number of EGMs 10. Additionally, any number of banks is possible in a gaming network 5. The gaming network 5 illustrated in FIGS. 2A and 2B is only an example gaming network. Those skilled in the art will appreciate that embodiments of the invention can operate on any acceptable network, even if it differs from the one illustrated.

Each bank is controlled by a bank controller 30, which is coupled to each EGM 10 by a communication cable 12. The bank controller 30 facilitates data communication between the EGMs 10 in its associated bank and the other components on the gaming network 5. In some embodiments, the bank controller 30 need not be present, and the EGMs 10 communicate directly with the other portions of the gaming network 5. The bank controller 30 can include audio capabilities, like an audio board or sound card for transmitting digitized sound effects, such as music and the like, to a sound system 34 coupled to the bank controller. Additionally, the bank controller 30 or sound system 34 may include a device for playing locally stored sounds, such as a hard-drive, CD or DVD-ROM drive. The bank controller 30 can also be connected to an electronic sign or screen 32 that displays information, such as scrolling, flashing, or other types of messages that indicate jackpot amounts and the like, which are visible to players of machines on a particular bank. These message displays 32, 34 may be generated or changed responsive to commands issued over the network 5 to the bank controller 30. The sounds and images created by the bank controller may be identical for each of the banks 20, 22, 24, or all of sounds and images created by the banks may be different than the others.

Configuration data for the gaming network 5 is stored in one or more network data repositories 61, 67, 69. In some embodiments, the data repositories 61, 67, 69 are made of battery backed-up non-volatile SRAM (Static Random Access Memory), which provides dual advantages of having extremely fast data input and output, and having a power source that is independent from the network 5 or the EGMs 10. The data repositories 61, 67, 69 may also be mirrored, i.e., duplicate copies are made in real-time. This prevents data from being lost if one of the battery sources should fail or other catastrophic event. Data may be stored in the data repositories 61, 67 69 using CRCs (Cyclic Redundancy Checks) and timestamps to ensure the data is valid and non-corrupt.

Configuration data is created at a configuration workstation 44 and stored in the data repositories 61, 67, 69. Configuration data may include message data for players as well as for promotions such as bonuses. Player message data is stored in the data repository 61, where it can be accessed by a player server 60. Player message data can include welcoming messages, card-in/card-out messages, and special messages about current promotions, for instance. Player message data can also include a threshold wager required to gain access to a secondary game, or data indicating that the wagered amount does not meet or equal the threshold, which can be a preselected or predetermined wager amount. The player server 60 reads the message data from the data repository 61 and sends a properly formatted message back to the bank controllers 30 and EGMs 10. These player messages may be displayed on a screen 32 for an entire bank, or may be shown on a screen directly mounted to the EGM 10 (not shown).

Other configuration data created at the configuration workstation 44 and stored in the data repositories 61, 67, 69 may include casino configuration data, such as identification of each EGM 10 on a casino floor. Additional parameters stored in the data repository 67, 69 are parameters used in promotions, such as bonus promotions. These parameters include such items as what EGMs 10 are included in the promotion, such as which EGMs are capable of playing secondary games, how to fund a bonus, i.e., if a bonus is funded by a portion of the coin-in amount of the EGMs 10, whether a paid bonus is to be taxed or non-taxed, and other parameters.

As players play the EGMs 10 in the gaming network 5, the EGMs send data from their coin meters, or meter values. One or more bonus server 66 stores these meter values, or summaries of the meter values, in its associated data repository 67.

The bonus servers 66 can also operate based on the present and stored meter values to determine an amount of money being wagered on the EGMs in near real-time. The bonus servers 66 can use the amount of money being wagered to calculate bonus pools that are funded as a percentage of the coin-in of participating EGMs 10. For instance, the bonus servers 66 can calculate a present amount of a bonus pool that is funded at one-half of one percent of the coin-in for the participating EGMs 10. An example of bonus promotions that can be operated from the bonus servers 66 includes LUCKY COIN and progressive bonuses, for example. Allowing players to access secondary games based on the amount of money being wagered on the EGMs 10 is yet another example of a bonus promotion that can be operated from the bonus servers 66.

The promotion server 68, like the bonus server 66, can use an amount of money being wagered to calculate promotion pools funded as a percentage of the coin-in. Alternatively, the casino or operator can configure the promotion server 68 to award promotions not related to coin-in, for example, incentives for enrolling in player tracking programs. Additionally, the promotion server 68 can be used to control access to a secondary game by storing a wager threshold at which the secondary game will be initiated. Upon reaching the wager threshold, the promotion server 68, can generate one or more signals to inform the bonus engine 220 to initiate secondary play. This function can likewise be performed by the game electronics 15 for gaming machines not part of a network.

The wager threshold can, but need not, be a wager amount, such as $100, or a type of wager, for example a maximum wager. The wager threshold can therefore be set at a preselected or predetermined amount and can be an amount less than a maximum wager. In some instances, the establishment might want to encourage play tracked through a player tracking card and therefore might want to set the wager threshold lower for players using such player tracking cards, or players the casino otherwise views as high-value.

The promotion server 68 may include functions and processes operative to generate signals to cause a system award to be generated and to communicate the generated system award to the particular EGM 10 at which the player receiving the award can receive the award. For example, the promotion server 68 can include a determiner to compare a wager to a preselected or prestored threshold or trigger. The determiner can, in turn, be coupled to a controller, such as in the bonus engine 220, which can be structured to initiate the secondary game in response to a signal received from the determiner. Therefore, as described above, the promotion server 68 may generate signals to permit access to the secondary game.

In determining when to grant a bonus or system award, or to initiate play on the secondary game, the promotion server 68 can access data stored anywhere on the network 5 looking for triggering events, such as: from any of the databases 100 described below; from any of the data repositories 61, 67, 69; from the bank controller 30; and from a bonus engine 220 (FIG. 1) on any or all of the EGMs 10 coupled to the gaming network.

When the promotion server 68 determines that a triggering event has been satisfied and that a system or bonus award should be generated or a secondary game initiated, it sends appropriate signals to the bonus engine 220 of the appropriate EGM 10 through the gaming network 5 to deliver the award or initiate the game. Records of awards, bonuses, and access to secondary games may be maintained by the promotion server 68 or elsewhere in the gaming network 5 for tracking and accounting purposes.

Of course, the servers 60, 66, 68 could be embodied in a single device, or in other configurations, and do not have to appear as in FIG. 2A, which is only a functional representation. Likewise, the data repositories 61, 67, 69 could be embodied in a single device.

As data is generated by the EGMs 10, data is passed through communication hardware, such as Ethernet hubs 46, and a concentrator 48. Of course, switches or bridges could also be used. The concentrator 48 is also coupled to a translator 50, which includes a compatibility buffer so that the data from the EGMs 10 can be used by a server cluster 56 (FIG. 2B), and other parts of the gaming network 5. A communication hub 102, in turn, is connected to the translator 50 and to an event monitor 104. The event monitor 104 is also coupled to a server cluster 56 (FIG. 2B). The server cluster 56 may, of course, be embodied by more than one physical server box. In practice, including multiple server boxes with dynamic load sharing and backup capabilities of one another ensures the gaming network 5 is nearly always operational.

The server cluster 56 is attached to and manages several databases, such as a slot accounting database 90, a patron management database 92, a ticket wizard database 94, a "Cage Credit and Table Games" (CCTG) database 96, a player tracking database 98, and a cashless database 99. These databases are collectively referred to as the databases 100. Of course these databases 100 are only exemplary, and more or fewer databases can be part of the gaming network 5. In some embodiments, particular servers in the server cluster 56 manage a single database. For example, a single server in the server cluster 56 may manage the slot accounting database 90, while another server manages the patron management database 92. Such implementation details are well within the expertise of one skilled in the art. However, for ease of illustration, FIG. 2B shows a single server cluster 56 that is coupled to all of the databases 100.

In operation, the slot accounting database 90 receives and stores statistical and financial information about the EGMs, such as dates, times, totals, game outcomes, etc. The patron management database 92 stores information regarding identified players, such as how often and which games they play, how often they stay in the casino, their total loyalty points, past awards, preferences, etc. The ticket wizard database 94 stores data about tickets that are issued by the EGMs, such as payouts and cashout tickets, as well as promotional tickets.

The CCTG database 96 stores information about non-EGM 10 data in a casino. That data is typically generated by a client station (not shown) coupled to one of the bank controllers 30. The client station can be located in a casino cage or at a table game, for instance, and data generated by the client station is forwarded to the CCTG database 96 where it is stored. For example, data such as when and how many chips a customer buys, when a customer creates or pays off markers, when a customer cashes checks, etc. is stored in the CCTG database 96.

The player tracking database 98 is a subset database of the patron management database 92, and is used when data retrieval speed is important, such as for real time promotions and bonusing. The cashless database 99 stores information about payment options other than bills, coins, and tokens.

Application clients 80 and 82 couple to the server cluster 56, and can retrieve data from any or all of the databases 100. Application programs run on an application client 80, 82 to provide users information about the gaming network 5 and the casino in which the network is established and to cause functions to operate on the gaming network 5. An example application client 80 could include, for instance, an accounting server that allows queries and provides reports on financial and statistical information on single or groups of EGMs 10.

A data interface 88 presents a uniform interface to other applications and servers (not shown), and grants access to retrieve data from the databases 100. Typically these other clients or servers would not be controlled by the same entity that provides the other components of the gaming network 5, and therefore the data interface 88 grants only guarded access to the databases 100.

Figure 3:
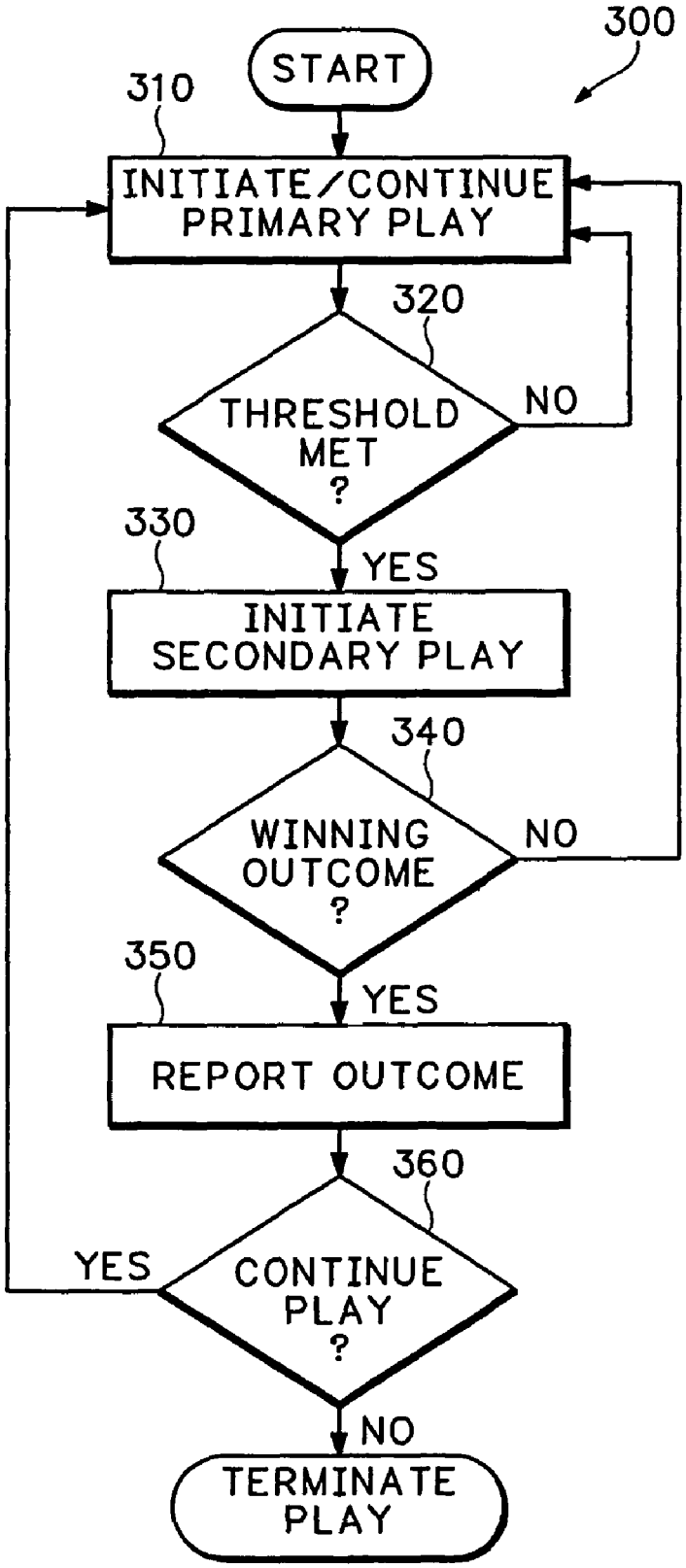
FIG. 3 is an example flow diagram showing example processes that can be performed by the network of FIGS. 2A and 2B to control access to a secondary game.
Figure 4:
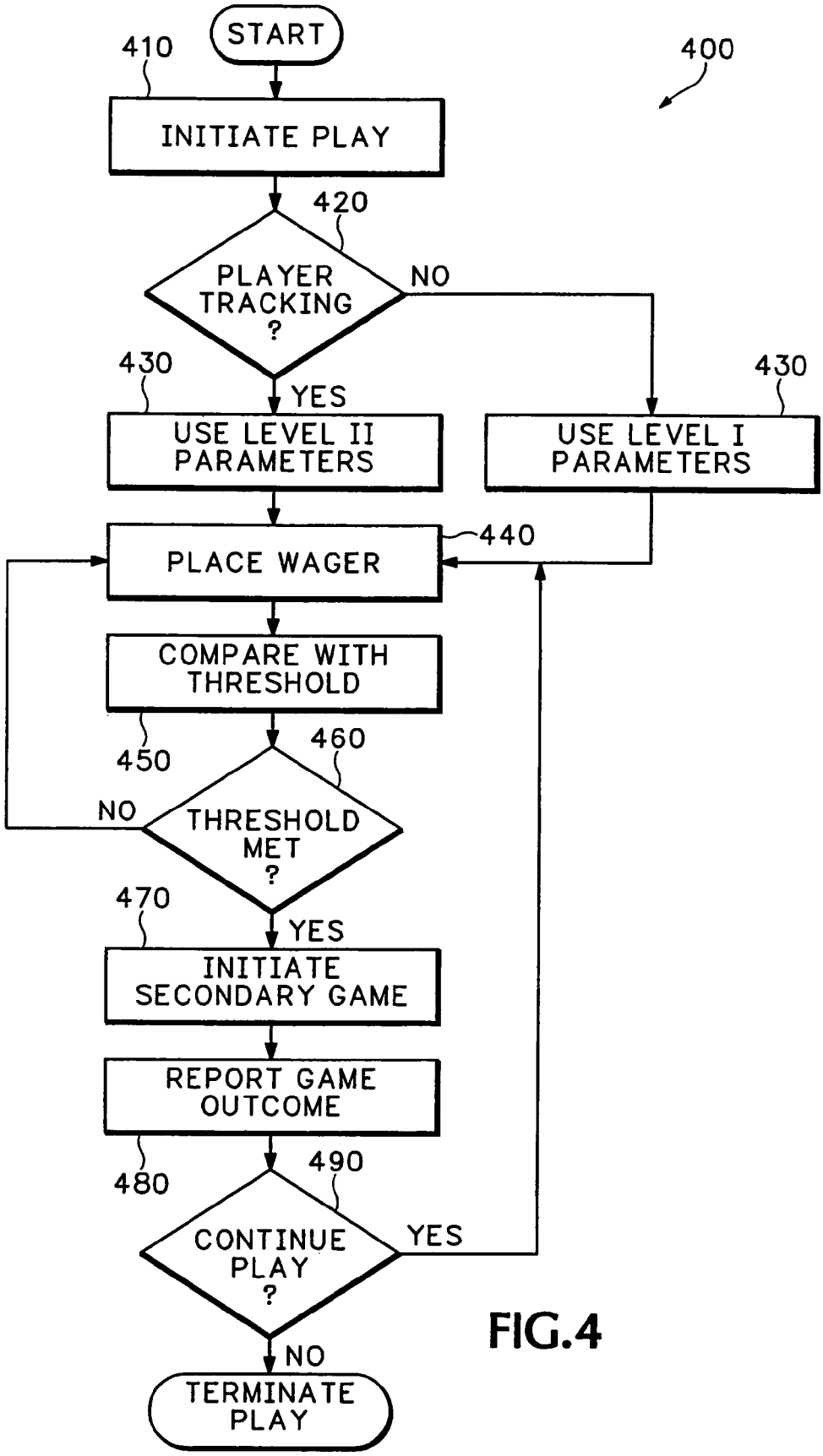
FIG. 4 is an example flow diagram showing additional example processes that can be performed by the network of FIGS. 2A and 2B, including establishing multiple thresholds to permit access to a secondary game.

Details of how the gaming network of FIGS. 2A and 2B permit access to a secondary game responsive to a wager made on a primary game are shown in FIGS. 3 and 4. FIGS. 3 and 4 are example flow diagrams illustrating processes that can be used by the system to initiate the secondary game and report outcomes of the primary and secondary games. For brevity, functions relating to comparing wagers to wager thresholds and triggering access to secondary games will be referred to as occurring on the promotion server 68, although they could be performed on the player server 60, bonus server 66, bonus engine 220, or elsewhere in the gaming network 5.

In FIG. 3, a flow 300 begins at process 310 where primary play is initiated, or continued in the event that flow is repeating, by making a wager. As previously discussed, a wager can represent coins or bills; amounts applied from credit cards, smart cards, player tracking cards; or credits drawn down from a credit meter through the actuation of one or more buttons, for example a maximum bet button. Wager, as used throughout this specification, can likewise refer to a single bet placed on a single machine, or can be the aggregation of several wagers on one or more machines. Player tracking cards enable casinos to track a given player's play across one or more gaming machines in a casino.

At a decision 320 the promotion server 68 compares the wager placed with a wager threshold to determine whether the threshold has been met or exceeded to trigger a signal communicating to the game electronics 15 that secondary play should be permitted. This comparison can be made before or after the outcome of primary play is reported to the player. In the event the threshold is not reached, the signal is not triggered, and the player is denied access to the secondary game. Following communication of the outcome of primary play to the player, the flow returns to process 310. In the event the threshold is reached, the flow continues to process 330.

The gaming machine can include signage to communicate to the player what the wager threshold for entering the secondary game is. In those establishments choosing to customize the wager threshold, thus changing the threshold for different times or days, this approach might not be practical. Therefore, in alternative embodiments the player will not know whether he has reached the threshold. To encourage a player who has not met the threshold to increase his wager, casinos can inform the player that the threshold has not been met, and can invite him to increase his wager in order to gain access to the secondary game. This information can be communicated to the player through audio associated with a gaming machine or bank of gaming machines 20, through an indicator light on the gaming machine, through a display associated with a gaming machine, such as the touchscreen display 218 described above, or through a printer 212 associated with the EGM 10 or bank of gaming devices 20 (FIG. 2A). Additional examples of how the threshold level can be communicated to one or more players include: the use of overhead signs, through public address, through vouchers, mailings, handouts, electronic devices, or personal digital assistants.

A casino can also designate the players to whom the threshold level will be made available. For example, the casino might want to limit the information to players belonging to a player tracking system or players having high player ratings based on criteria established by the casino. The casino could make the threshold level available to these particular players through access controlled internet or electronic means, or by making the information available on a display associated with the EGM 10 after the player enters a personal identification number (PIN), uses a player tracking card, or otherwise makes his/her presence known to casino personnel or the network 5.

At a process 330, play on the secondary game is initiated. Play will continue on the secondary game according to configuration data applied to the promotion server 68. Play on the secondary game can occur simultaneously with, or subsequent to, play on the primary game. Secondary play can require some action by the player or can occur without player involvement. For example, a player could be invited to actuate one or more buttons in order to generate an outcome in the secondary game, or the secondary game can reveal an outcome without the necessity of the player actuating a button.

At decision 340 the system determines whether a winning outcome has been generated. In the event there is no winning outcome, the player has the option to continue playing, in which case he returns to process 310, or terminate play on the game. In the event a winning outcome has been generated, the flow proceeds to process 350.

At a process 350 the player is advised of the outcome of the primary and secondary games through first and second indicators on the games. In some embodiments a casino might want to report the outcome of the primary game to the player via a first indicator prior to or immediately after initiation of the secondary game. The casino might want to report the outcome of the secondary game via a secondary indicator following completion of the secondary game. The casino can configure the system to always report the outcome of the primary game first, to always report the outcome of the secondary game first, or to randomly report the outcome of each game. Alternatively, the casino could choose certain outcomes for which the primary outcome is reported first, and others where the secondary outcome is reported first. The decision of when to report an outcome and the order of reporting outcomes are options configurable by the casino according to its own preferences. Any such timing or order are contemplated and within the scope of the invention.

At decision 360 the player again determines whether to continue playing, in which case the flow returns to process 310. If the player elects to stop playing, play is terminated.

FIG. 4 is another example of a flow diagram illustrating processes that can be used by the promotion server 68 to initiate play on the secondary game. A flow 400 begins at process 410 with the initiation of play on the EGM 10 which can, but need not, be coupled to a network 5. As in FIG. 3 play can be initiated by applying money or credits to a credit meter associated with one or more gaming devices. One order has been chosen and demonstrated for purposes of FIGS. 3 and 4 although other orders are contemplated and within the scope of the invention.

At a decision 420 the promotion server 68 will determine whether a player tracking card is use. In the event play is not being tracked, the flow will be similar to that described with respect to FIG. 3, and will proceed with the first threshold level at a process 430. In the event a player tracking card is in use, the promotion server 68 can designate a second wager threshold, also at a process 430. To encourage play with such tracking cards, the threshold is preferably lower, although the casino can configure each level according to its own preference. Casinos can likewise have additional wager thresholds depending on the level of play they hope to achieve from different types of players or different playing scenarios.

At a process 440 a wager is placed and at a process 450 the wager is compared with the appropriate threshold to determine whether the threshold has been met. If the threshold has been met at decision 460, the flow continues through to process 470 to initiate play on the secondary game. The promotion server 68 keeps records of secondary play for accounting purposes. At a process 480 the outcome is again reported and at decision 490 the player determines whether to continue play or terminate play on the game.

Using the system described with reference to FIGS. 1 and 2A and 2B and further described above in FIGS. 3 through 4, casinos can control access to secondary games to enhance a player's playing experience and encourage the player to place maximum wagers.

Although particular embodiments for controlling access to secondary games have been discussed, it is not intended that such specific references be considered as limitations upon the scope of this invention, but rather the scope is determined by the following claims and their equivalents.

What is claimed is:

1. A method for controlling access to a secondary game on a gaming machine during play of a primary game, said method comprising:

determining if the player is enrolled in a player tracking system;

presenting a preselected wager threshold to a player via at least one of a visual message and an audio message, wherein the preselected threshold is determined based on player enrollment in the player tracking system;

accepting a wager from the player via a gaming machine input device;

comparing, by a server, the accepted wager to the preselected wager threshold;

prompting the player to increase the accepted wager when the accepted wager is less than the preselected wager threshold;

when the accepted wager equals the preselected wager threshold, receiving a trigger signal at the gaming machine;

initiating the secondary game, by the gaming machine, in response to the trigger signal, wherein initiation of the secondary game is based only on the comparison of the accepted wager to the preselected wager threshold and regardless of an outcome of the primary game; and reporting the outcome for play of the primary game via a gaming machine primary indicator and an outcome for play of the secondary game via a gaming machine secondary indicator.

2. The method of claim 1, wherein accepting the wager comprises accepting the wager for play of the primary game.

3. The method of claim 1, further comprising initiating the secondary game when the accepted wager exceeds the preselected threshold.

4. The method of claim 1, wherein comparing the accepted wager comprises comparing the accepted wager to a maximum wager.

5. The method of claim 1, wherein comparing the accepted wager comprises comparing the accepted wager to an amount less than a maximum wager.

6. The method of claim 1, wherein prompting the player to increase the accepted wager comprises denying access to the secondary game in response not receiving the trigger signal at the gaming machine.

7. A system for allowing secondary play on a gaming machine having a primary game and a secondary game, said system comprising:

a monitor configured to display a prestored trigger to a player via a visual message; and a server comprising:

a determiner structured to compare a wager to the prestored trigger; and a controller coupled to said determiner and structured to determine if the player is enrolled in a player tracking system, transmit a trigger signal to the gaming machine to initiate the secondary game, wherein said controller is configured to transmit the trigger signal when the wager meets the prestored trigger and the player enrollment in the player tracking system, regardless of either a timing of the comparison of the wager to the prestored trigger and an outcome of the primary game, said controller further structured to report at least one of the outcome for play of the primary game and an outcome for play of the secondary game.

8. The system of claim 7, further comprising a first indicator coupled to the primary game and a second indicator coupled to the secondary game.

9. The system of claim 8, wherein the first indicator is a reel.

10. The system of claim 8, wherein the second indicator is a reel.

11. The system of claim 7, wherein the prestored trigger is a wager type.

12. The system of claim 11, wherein the wager type is a maximum wager.

13. The system of claim 7, wherein the prestored trigger is a wager amount.

14. The system of claim 7, wherein the prestored trigger is a wager source.

15. The system of claim 14, wherein the wager source is a player tracking card.

16. A method of initiating a secondary game on a gaming machine during play of a primary game, said method comprising:

determining whether a player is enrolled in a player tracking system;

permitting play on the primary game using the gaming machine;

presenting to the player via at least one of a visual message and an audio message one of a first predetermined threshold and a second predetermined threshold that is different than the first predetermined threshold, wherein the first predetermined threshold only applies to players enrolled in the player tracking system and wherein the second predetermined threshold applies to players not enrolled in the player tracking system;

accepting a wager via a gaming machine input device;

comparing, by a server, the wager to the one of the first and second predetermined thresholds;

transmitting a trigger signal from the server to the gaming machine when the accepted wager equals one of the first predetermined threshold when it is determined that the player is not enrolled in the player tracking system, and the second predetermined threshold when it is determined that the player is enrolled in the player tracking system;

permitting play on a secondary game at the gaming machine in response to the trigger signal, wherein permission to play the secondary game is based only on the comparison of the wager to one of the first and second predetermined thresholds regardless of a timing of the comparison of the wager to one of the first and second predetermined thresholds;

reporting a first outcome responsive to play on the gaming machine via a first indicator; and reporting a second outcome responsive to play on the gaming machine via a second indicator.

17. The method of claim 16, wherein the first outcome is a primary game outcome and the second outcome is a secondary game outcome.

18. The method of claim 16, wherein the first outcome is a secondary game outcome and the second outcome is a primary game outcome.

19. The method of claim 16, wherein the first outcome is a randomly selected outcome.

20. The method of claim 16, wherein play on the secondary game is permitted when the wager exceeds one of the first and second predetermined thresholds.

21. A system for accessing a secondary game during play of a primary game, said system comprising:

a plurality of gaming machines that each comprises:

a data input device configured to accept a wager from a player;

a player tracking device configured to accept a player tracking card from the player; and a monitor configured to display one of a first wager threshold and a second wager threshold that is different than the first wager threshold;

a server coupled to the plurality of gaming machines, wherein said server comprises:

a player tracking determiner configured to determine whether the player is enrolled in a player tracking system based on signals received from said player tracking device; and a comparator configured to:

compare the wager to the one of the first and second wager thresholds, wherein the wager is compared to the first wager threshold if the player is not enrolled in the player tracking system, and wherein the wager is compared to the second wager threshold if the player is enrolled in the player tracking system;

prompt the player via said monitor to increase the wager if the wager is less than the one of the first and second wager thresholds; and transmit a trigger signal to at least one of the plurality of gaming machines to initiate a secondary game based only on the comparison of the wager to one of the first and second wager thresholds, wherein the comparator is configured to transmit the trigger signal only when the wager is at least equal to and greater than the one of the first and second wager thresholds and not when the wager is less than the one of the first and second wager thresholds, wherein the comparison of the wager to one of the first and second wager thresholds occurs regardless of at least one of an outcome of the primary game, and a timing of the comparison of the wager to one of the first and second wager thresholds.

* * * * *